United States Patent [19]

Scheuermann

[11] 4,396,871

[45] Aug. 2, 1983

[54] ARRANGEMENT FOR DIGITAL BRIGHTNESS CONTROL OF LAMPS

[76] Inventor: Klaus Scheuermann, 2, Tulpenweg, Jena, District of Gera, German Democratic Rep.

[21] Appl. No.: 235,832

[22] Filed: Feb. 19, 1981

[30] Foreign Application Priority Data

Mar. 3, 1980 [DD] German Democratic Rep. ... 219372

[51] Int. Cl.[3] ..... H05B 37/02

[52] U.S. Cl. ..... 315/291; 315/195; 315/199; 315/293; 315/294; 323/322

[58] Field of Search ..... 315/194, 195, 199, 208, 315/291–294, 312, DIG. 4; 323/322; 364/480

[56] References Cited

U.S. PATENT DOCUMENTS 4,241,295 12/1980 Williams ..... 315/199 X

FOREIGN PATENT DOCUMENTS 52-16883 2/1977 Japan ..... 315/291

54-03384 1/1979 Japan ..... 315/292

*Primary Examiner*—Eugene R. La Roche

[57] ABSTRACT

The invention relates to an arrangement for digital brightness control of lamps or groups of lamps in control channels particularly for use in planetarium illumination comprising in each control channel a programmable counter, a bistable flip-flop, and a power control stage. Each control channel is connected to a mains synchronizing stage and to a pulse generator. The control channel produces a mains synchronous pulse sequence frequency the pulse width repitition ratio of which depends on the selected division ratio of the programmable counter. The inventional solution offers a simple digital and controllable circuit arrangement for control of thyristors or triacs or transistors which, in turn, control the brightness of lamps or lamp groups.

2 Claims, 1 Drawing Figure

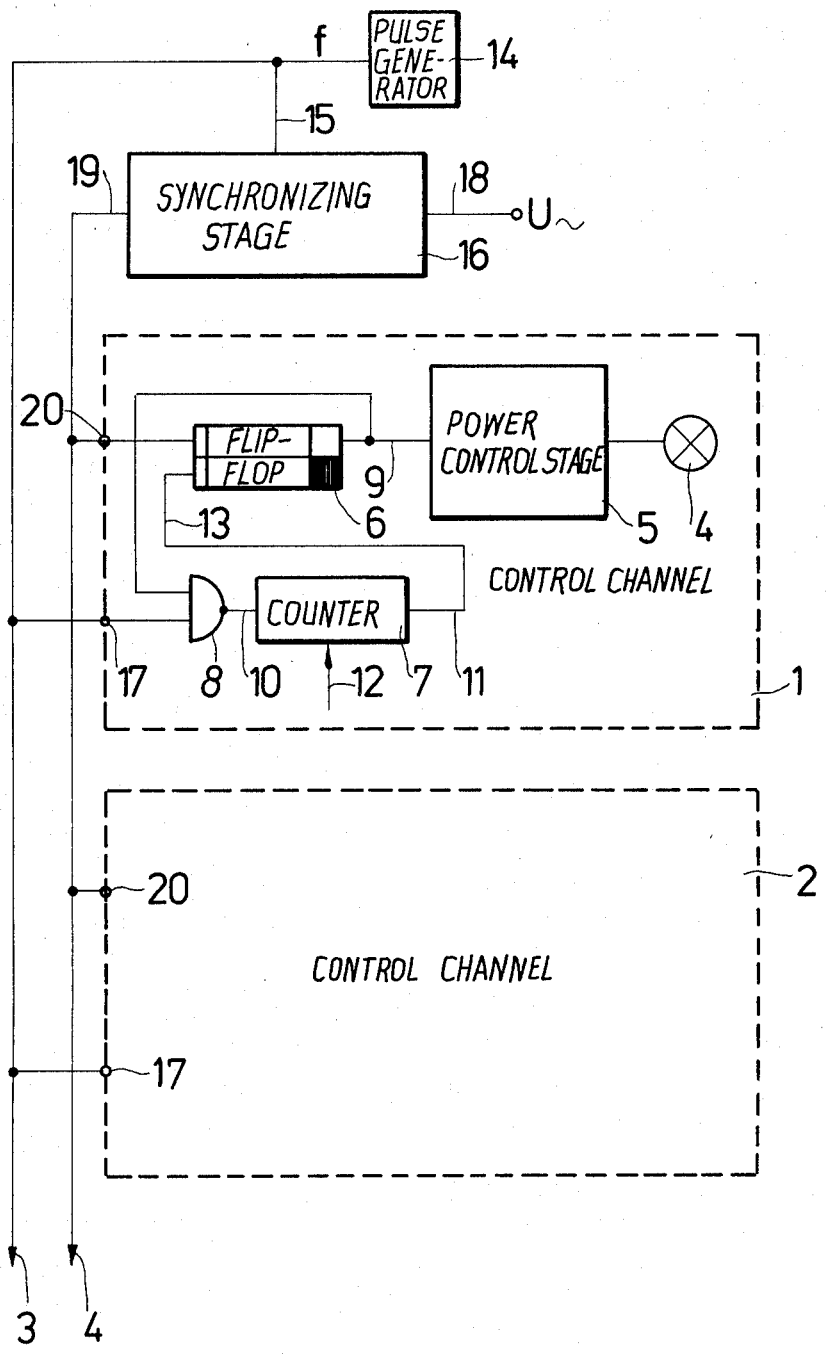
f
PULSE GENE-RATOR
14
15
19
SYNCHRONIZING STAGE
18
U~
16
20
FLIP-FLOP
9
POWER CONTROL STAGE
13
6
5
4
CONTROL CHANNEL
COUNTER
17
8
10
12
7
11
1
20
2
CONTROL CHANNEL
17
3
4

ARRANGEMENT FOR DIGITAL BRIGHTNESS CONTROL OF LAMPS

The invention relates to an arrangement for digital continuous brightness control of lamps, particularly for use in planetaria, comprising a one or multiphase mains synchronizing stage for producing mains synchronizing pulses and at least one control channel including a power stage constituted of translators or thyristors for control of a lamp or lamp group in a brightness control raster.

Thus it is feasible to control the brightness of lamps or lamp groups of different voltages, types and geometry independent on one another.

The inventional arrangement can be used in planetaria, and for illumination effects in cinemas, theaters and the like.

It is known to produce one hundred cycle pulses by a Graetz-or full-wave rectification and an opto-coupler followed by a trigger circuit.

Said pulses are fed into a first input of an integrator. A square wave pulse sequence is fed into a second input of said integrator. The square wave pulse sequence is varied into a saw tooth pulse sequence at the output of the integrator and is reset through the 100 cycle pulse synchronous to the mains.

The saw tooth pulse sequence is applied to a first input of a comparator, into the second input of which a d.c. voltage is fed derived either via a d.c. voltage source or a D/A converter.

The comparison of the saw tooth pulse sequence and the d.c. voltage produces a pulse modulated control signal which lies at the output of the comparator suitable for thyristors or traics.

This solution is disadvantageous since, when using d.c. voltage sources, a very precise and continuous d.c. voltage has to be supplied. Though the use of D/A converters is suitable for a program control, in particular by computers, the expenditures increase very considerably.

A further known solution employs the analog signal of D/A-converters to control transistors which, in turn, are used to control lamps.

Apart from the high expenditures required this solution is disadvantageous due to the high power which is involved when operating transistors in the active range.

It is further known to control thyristors and triacs through special circuits (Teslaprospect) having analog inputs.

Said circuits are only digitally controllable through the analog input via D/A converter stages, which again renders the technical and economical expenditures comparatively high.

The "Leitfaden der elektronischen Steuerungs- and Regelungstechnik" published by Transis Press, Munich, describes a circuit arrangement with a digital set-input for firing thyristors and triacs by use of uni-junction transistors. A pulsed d.c. voltage produced by a transformer (or series resistor) via a full-wave rectification charges a capacitor via series-resistors until the breakdown voltage of the uni-junction transistor is arrived at. The capacitor is discharged via the uni-junction transistor, the circuit flows in the gate connection of a triac or in the primary winding of a pulse transmitter, in the event of using thyristors in anti-parallel connection.

The collector-emitter path of a bipolar transistor lies across a part of the series resistor. By a pulse fed into the base of the bipolar transistor the charging of the capacitor and, hence, the firing of the triacs or thyristors is suppressed.

This circuit arrangement is only controllable via computer when an expensive digitalising is involved. The same publication discloses the control of thyristors and triacs via diacs through an analog input signal. As already mentioned such circuit arrangements are only digitally controllable via expensive D/A converter stages.

To eliminate the expensive D/A conversion it is necessary to employ a digital drive circuit when the thyristors have to be digitally controlled.

It is an object of the invention to obviate the above disadvantages.

It is a further object of the invention to provide a simple circuit arrangement for selective program control of thyristors.

These and other objects are realised by a circuit arrangement for digital brightness control of lamps, particularly for use in planetaria illumination, comprising a one or multiple phase mains synchronizing stage for producing mains synchronous pulses and at least one control channel including a power control stage constituted of transistors, triacs or thyristors.

The circuit arrangement controls a lamp or group lamps in the steps of a brightness raster.

Furthermore, a pulse generator, a programmable counter and a logic stage are provided for each control channel. The pulse generator produces a pulse sequence corresponding to the frequency of the mains synchronous pulses divided by the bit number of the brightness raster.

The output of the pulse generator is connected to each programmable counter and to each first input of each logic stage via the mains synchronizing stage. In each control channel the output of the respective programmable counter associated to the respective power control stage is connected to a second input of a logic stage series-connected to said respective power control stage.

Advantageously a bistable flip-flop is provided in the logic stages of each control channel.

The first input of said flip-flop is connected to the output of the mains synchronizing stage, the second input of which is connected to the output of the programmable counter of the respective control channel and the output of which is connected to the input of the power control stage of the respective control channel.

The pulse generator is connected via a gate circuit controlled through the output of the bistable flip-flop to the input of the programmable gate circuit.

It is a further advantage when the pulse generator and the programmable counter are integral components of a digital computer system.

The control of the lamp or lamp group thyristor or triac is performed by mere digital means without the necessity of employing expensive D/A-converters. Since the circuit arrangement comprises a mains synchronizing stage, a pulse generator, a power control stage for each control channel, and a power control stage of the generally known type, the circuitry and the components required are reduced to a minimum.

A digital program control is feasible provided that the programmed counters and, possibly, the pulse generators are components of a computer system. The course of the brightness control of the lamp systems can either be time dependent, or directional, that is, programmed, which means that even complicated control operations can be solved in a comparatively simple manner.

The inventional arrangement can be used in planetaria illumination since the already present computer system for the planetarium control can be shared.

But even without computer control the inventional circuit arrangement permits a brightness control, programmable in preselected speeds.

The brightness control can also be interrupted at any desired program step and can be reversed.

The core of the inventional circuit arrangement is the logic state of each control channel and its connection to the pulse generator, to the mains synchronizing stage and to the power control stage.

The logic stage produces a mains synchronous pulse sequence at a pulse width-repetition rate which real time varies at the divider ratio of the programmable counter.

In order that the invention may be more readily understood reference is made to the accompanying drawing which illustrates diagrammatically and by way of example one embodiment thereof and where the FIGURE is a schematic view of an arrangement for brightness control.

In the FIGURE two control channels 1 and 2 include (only in channel 1 shown) a lamp 4, the brightness of which is to be controlled, a power control stage 5, a bistable flip-flop 6, a programmable counter 7 and a gate circuit 8.

The lamp 4 is connected to the output of the power control stage 5, which, in turn, is connected via the input 9 to the output of the bistable flip-flop 6. The output of the latter is also connected to a first input of the gate circuit 8 the output of which is connected to the input 10 of the programmable counter 7.

The output 11 of the counter 7, programmable via a set input 12, is connected to a first input 13 of the bistable flip-flop 6.

A pulse generator 14 of a pulse sequence frequency f is connected via its output to an input 15 of a mains synchronizing stage 16 and via terminals 17 to the respective gate circuit 8 of each control channel 1, 2. An a.c.-voltage V~ of mains frequency is applied to a second input 18 of the synchronizing stage 16.

The output 19 of the latter is connected via terminals 20 to the respective second inputs of the bistable flip-flop 6 of the respective channels 1, 2.

The lines 3, 4 are provided for further control channels not shown for the sake of simplicity. The lines 3, 4 represent the connection of the pulse generator 14 and the synchronizing stage 16 to the terminals 17 and 20, respectively, of the control channels not shown.

In operation the lamp 4 is controlled by a digitally subdivided brightness raster.

When a digital 8-bit brightness raster is used the brightness control of the lamp 4 is divided into $2^8=256$ brightness steps.

The mains synchronizing stage 16 produces a pulse sequence frequency of 100 Hz at zero passage of the rectified a.c.voltage V~.

The pulse generator 14 supplies a very stable pulse sequence frequency f which corresponds to the pulse sequence frequency subdivided by the bit-number of the brightness raster of the mains synchronizing pulses. Concerning the 8-bit brightness raster this will yield a pulse sequence frequency $f=2^8\times 100$ Hz=25.6 khz which are applied to the input 15 of the mains synchronizing stage 16.

The latter synchronizes said frequency f and the pulse sequence obtained from the rectified a.c. voltage V~ so that a 100 Hz-pulse sequence synchronous to the pulse sequence frequency f lies across the output of the mains synchronizing stage 16.

Advantageously the synchronizing is performed in a not shown D-flip-flop.

The pulse sequence frequency f of the pulse generator 14 is fed via the gate circuit 8 into the input 10 of the programmable counter 7 which is programmed via the set-input 12.

Preferably the counter 7 is a backward counter. Each first output signal of the counter 7 at the output 11 sets the bistable flip-flop 6 via the input 13. The flip-flop 6 drives the power control stage 5 and at the same time blocks the gate circuit 8. The next coming synchronized 100 Hz pulse from the mains synchronizing stage 16 via the terminal 20 resets the flip-flop 6 and hence the gate circuit 8 is rendered in the ON-state.

The next half-wave of the a.c.-voltage V~ repeats the above operation.

At the input 9 of the power control stage 5 a mains synchronizing pulse sequence is produced the pulse width repetition ratio of which varies at the programmable pulse width repetition ratio n of the counter 7.

Thus an 8-bit phase control for thyristors or triacs is feasible. When the power control stage 5 is constituted of transistor circuits the pulses at the input 9 switch the transistors from the saturation range to the Off-range and vice versa.

Due to the inertia of the lamp 4 the optical output is the integral of the electrical input of the transistor circuit.

Due to the persistency of the human eye only the medium brightness value is perceived.

It is of advantage to program the counter 7 by means of a microcomputer (not shown) connected to the set input 12.

By suitably pre-programming and computer controlled setting of the counter 7 linear and non-linear dark/bright or bright/dark control and circuit operations are feasible.

Furthermore, the preselection of speeds is feasible corresponding to the bit number of the brightness control raster, in the present example eight preselected speeds.

At any desired time a stop or direction change signal can be delivered.

In the event of only switching the lamp 4 rather than a continuous control, the counter 7 division ratio is provided with two set values, the one value realising the "dark state" the other the "bright-state". Furthermore diverse bright values can be controlled. When the brightness control raster has a different bit number, the pulse generator 14 has to produce a different pulse sequence frequency f according to the frequency of the mains synchronous pulse of the main synchronization stage 16, subdivided by the desired bit number of the brightness control. Furthermore, it is feasible to integrate the programmable counter 7 and the pulse generator 14 into the microcomputer, that is, the counting operation as well as the pulse generation of the constant pulse sequence frequency f are performed by the microcomputer by, for example, CTS channels controlled by the bus-system of the computer.

The bus-controlled operation is particularly suitable for planetaria illumination control where the microcomputer for servo-motor control can be shared. The inventional arrangement is, however, not restricted to the use in planetaria.

I claim:

1. An arrangement for digital brightness control of lamps in control channels, particularly for use in planetaria illuminations, comprising at least one lamp, at least one power control stage for brightness control of said lamp in digitally divided steps of a brightness raster, at least one programmable counter having a counter input, a set input and an output, at least a bistable flip-flop having two inputs and one output, at least a gate circuit having two inputs and one output, said lamp, said power control stage, said counter, said flip-flop and said gate circuit constituting one of said control channels, said output of said flip-flop being connected to one of said two inputs of said gate circuit and to said input of said power control stage, said output of said power control stage being connected to said lamp, said gate circuit output being connected to said counter input, said counter output being connected to one of said two flip-flop inputs, said counter being programmable via said set input, a mains synchronizing stage having two inputs and one output, said synchronizing stage being for producing mains synchronous pulses, said output of said synchronizing stage being connected to the other of said two flip-flop inputs, a voltage source being connected to the one of said two inputs of said synchronizing stage, a pulse generator being connected to the other of said two inputs of said synchronizing stage and to the other of said two inputs of said gate circuit, said pulse generator being for producing a pulse sequence frequency corresponding to the frequency of the mains synchronous pulses divided by steps determined by the bit number of said brightness raster.

2. An arrangement as claimed in claim 1, wherein said pulse generator and said counter are integral components of a digital computer.

* * * * *